US007941974B2

(12) United States Patent
VanBasten et al.

(10) Patent No.: US 7,941,974 B2
(45) Date of Patent: May 17, 2011

(54) INFLATABLE SHELTER FOR USE IN HOSTILE ENVIRONMENT

(76) Inventors: Willem F. VanBasten, Warminster, PA (US); Edward V. Roscioli, Easton, PA (US)

( * ) Notice: Subject to any disclaimer, the term of this patent is extended or adjusted under 35 U.S.C. 154(b) by 68 days.

(21) Appl. No.: 11/944,477

(22) Filed: Nov. 23, 2007

(65) Prior Publication Data

US 2008/0120919 A1 May 29, 2008

Related U.S. Application Data

(60) Provisional application No. 60/867,433, filed on Nov. 28, 2006.

(51) Int. Cl.
*E04B 1/34* (2006.01)

(52) U.S. Cl. ..... 52/2.11; 52/2.17; 52/2.18; 52/79.5; 299/12

(58) Field of Classification Search ..... 52/2.17, 52/2.22, 2.11, 2.18, 2.19, 79.5; 229/12, 95
See application file for complete search history.

(56) References Cited

U.S. PATENT DOCUMENTS

| | | | | |
|---|---|---|---|---|
| 4,815,363 | A * | 3/1989 | Harvey | 454/168 |
| 5,331,991 | A * | 7/1994 | Nilsson | 135/93 |
| 5,537,784 | A | 7/1996 | Baldwin | |
| 5,630,296 | A | 5/1997 | Kendall | |
| 5,706,846 | A | 1/1998 | Sutton | |
| 6,192,633 | B1 * | 2/2001 | Hilbert | 52/2.18 |
| 6,708,451 | B1 * | 3/2004 | Gomes | 52/2.17 |
| 2002/0083653 | A1 * | 7/2002 | Hilbert | 52/2.17 |
| 2006/0055193 | A1 * | 3/2006 | Colborne | 296/24.3 |
| 2007/0199244 | A1 | 8/2007 | Kennedy | |
| 2008/0106137 | A1 * | 5/2008 | Paton-Ash et al. | 299/12 |
| 2008/0313969 | A1 * | 12/2008 | Colucci et al. | 52/2.18 |

FOREIGN PATENT DOCUMENTS

WO 2005086613 A2 9/2005

* cited by examiner

*Primary Examiner* — Eileen Lillis
*Assistant Examiner* — Branon C Painter
(74) *Attorney, Agent, or Firm* — William H. Eilberg

(57) ABSTRACT

A flexible, inflatable shelter is held within a storage container. The shelter can be erected rapidly, by directing compressed gas held or produced within the container, into the flexible material which will define the finished shelter. Personnel using the shelter then enter through an air lock door located in the storage container. An air lock may be alternatively provided such that is located at least partly within the deployed shelter, and so that it does not occupy substantial space in the container. The container includes supplies necessary to sustain life for an extended period. The shelter can be used to protect personnel from harmful environments caused by accidents or explosions in mines, tunnels, industrial plants, and the like. The container is compact, but allows rapid deployment of the flexible material to produce a shelter which is of approximately the same volume, or greater, than that of the storage container.

7 Claims, 14 Drawing Sheets

INFLATABLE SHELTER FOR USE IN HOSTILE ENVIRONMENT

CROSS-REFERENCE TO PRIOR APPLICATION

Priority is claimed from U.S. provisional patent application Ser. No. 60/867,433, filed Nov. 28, 2006, the disclosure of which is hereby incorporated by reference.

BACKGROUND OF THE INVENTION

The present invention relates to shelter systems for use in emergency situations, providing temporary shelter for persons who are trapped in a hostile environment.

More specifically, the invention relates to systems and devices for providing breathable air for shelters used to protect humans from unsafe atmospheres, such as those which are deficient in oxygen, or which contain unsafe levels of carbon monoxide, methane, or other toxic chemicals, including toxic industrial chemicals or chemical, biological, or radiological warfare agents.

Typical events which could cause the local atmosphere to become unsafe for human respiration include mine or tunnel emergencies, fires, terrorist activity, acts of war, chemical spills or other industrial accidents, and accidents at nuclear power plants. These events could take place in a mine, a tunnel, or a building. They could also occur outside, where such events could produce an atmospheric plume which is unsafe for breathing.

Political and criminal events in the early twenty-first century have highlighted, to an unprecedented level, the threat of a terrorist attack by "weapons of mass destruction", such as chemical, biological, or radiological agents, or toxic industrial chemicals. Mine emergencies, in which the atmosphere inside the mine becomes unsafe for human respiration, have taken the lives of numerous miners throughout the history of underground mining. Fires in high-rise buildings, both commercial and residential, have caused the atmosphere above the level of the fire to become unsafe for human respiration. The result has been loss of life due to asphyxiation from toxic chemicals or inhalation of smoke.

For the above reasons, systems for protection of persons from the above-described events have become highly desirable.

An example of an emergency shelter for use in a hostile environment is shown in international patent publication No. WO 2005/086613, the disclosure of which is incorporated by reference herein. The above-cited document describes a collapsible shelter which can be quickly configured to provide a breathable atmosphere in which persons trapped in an emergency situation can survive.

The present invention provides a further improvement over the emergency shelters of the prior art.

SUMMARY OF THE INVENTION

The present invention includes a storage container, intended to be kept indefinitely at or near a site of a potential emergency, such as in a mine or tunnel or other installation. The storage container includes all of the materials necessary for quickly erecting a shelter for protecting personnel from a hostile environment, such as would be experienced in a mine explosion, a fire, a terrorist attack, or in other emergency situations. The shelter and container are completely sealed against intrusion of harmful gases, and preferably contain enough breathable air to keep the shelter under positive pressure during a designated rescue period, such as up to 96 hours.

The storage container used in the present invention includes a flexible, inflatable shelter, intended to be inflated by a compressed gas stored or produced within the container. The container also houses a source of gas which can be directed into the inflated shelter to provide a breathable atmosphere.

The storage container also includes an air lock door, preferably located on a side of the container which is distinct from the side from which the flexible and inflatable shelter emerges. Personnel using the shelter pass through the air lock door, the air lock door being closed off from the outside before the personnel proceed into the inflated shelter. In this way, toxic gas from the outside is prevented from entering the shelter while the personnel are entering.

The storage container preferably also includes sufficient supplies to sustain life for personnel within the shelter, for a period of at least several days. The container may include other supplies, such as communications equipment, for contacting rescuers located, for example, at the surface of a mine, or otherwise outside the shelter.

The air lock door may comprise a flexible door which can be made to extend outward from the storage container, and through which personnel can enter the container on their way into the inflated shelter. Alternatively, the air lock door may be rigid, and may be formed of one or more non-flexible doors which also prevent inflow of harmful gases into the shelter.

In another, and more preferred embodiment, most of the air lock is located within the flexible material defining the shelter. This arrangement conserves space in the storage container, enabling more supplies to be stored in such container. The air lock is folded into the flexible material for storage, and is deployed together with the shelter. When deployed, the air lock is fully, or at least partially, contained within the shelter.

The storage container preferably rests on a skid. Although the container may be permanently stored at one location, it may occasionally be desirable to move the container to another location. The skid makes it easier to do so.

The invention therefore has the primary object of providing a shelter for protecting personnel from a hostile environment in an emergency situation.

The invention has the further object of providing an emergency shelter for use in mines, tunnels, industrial plants, or other locations at which hazardous atmospheres may be created in emergency situations.

The invention has the further object of providing an emergency shelter for protection of personnel following a terrorist attack.

The invention has the further object of providing a compact, self-contained unit which can be used for rapid erection of a shelter in the event of an emergency.

The invention has the further object of providing an apparatus and method for protecting personnel from hostile environments, for extended periods of time, in emergency situations.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
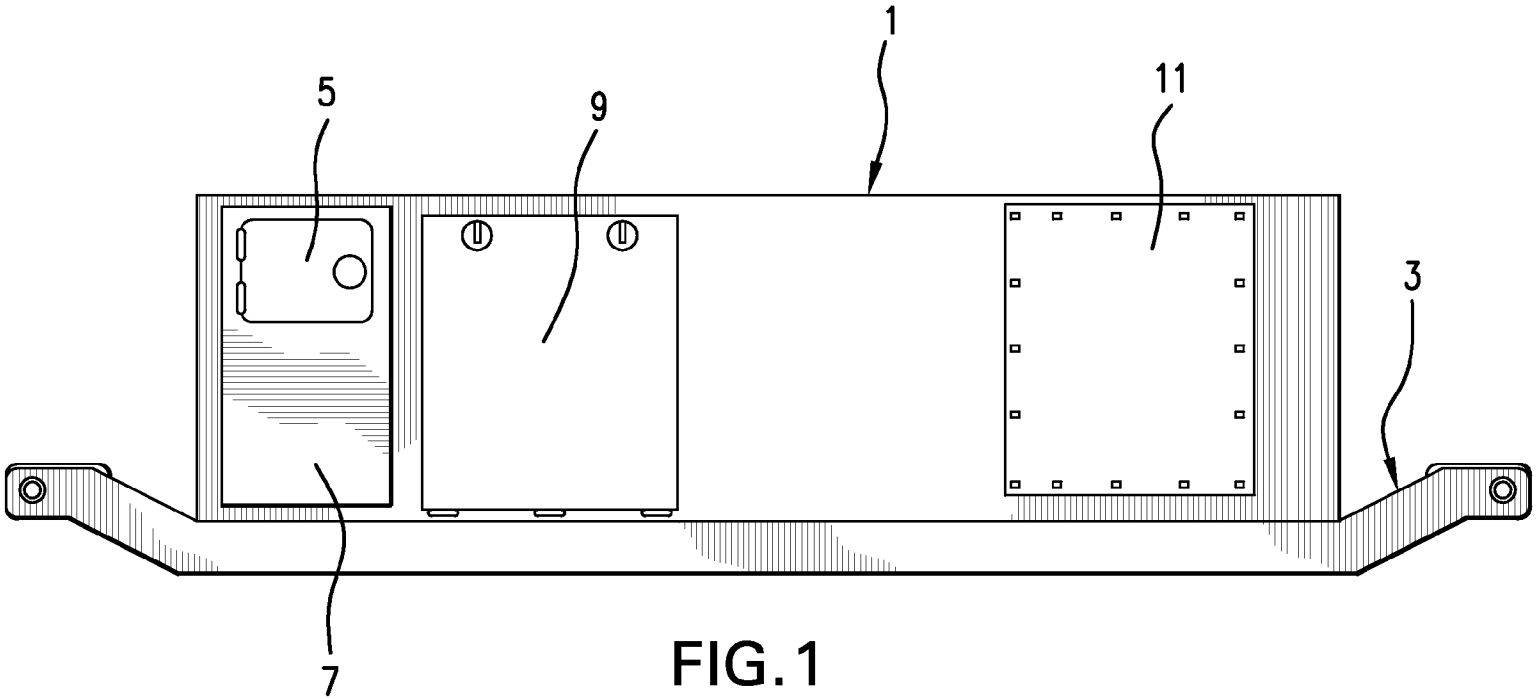
FIG. 1 provides a front elevational view showing the storage container of the present invention, the container being held on a skid, the figure showing the doors of the container in a closed position.

FIG. 1 provides a front elevational view of one embodiment of the storage container used in the present invention. Storage container 1 sits on skid 3. Instead of a skid, one could use some other device such as a wheeled platform or trailer. The storage container is preferably made of a rigid and durable material, such as steel. The skid may similarly be made of metal. The storage container holds all of the components necessary to erect a shelter, as well as materials necessary to sustain life within the shelter for an extended period. In the view of FIG. 1, all of the doors of the storage container are closed. Specifically, the figure shows valve access door 5, service access door 7, entrance ramp door 9, and service access panels 11.

Figure 2:
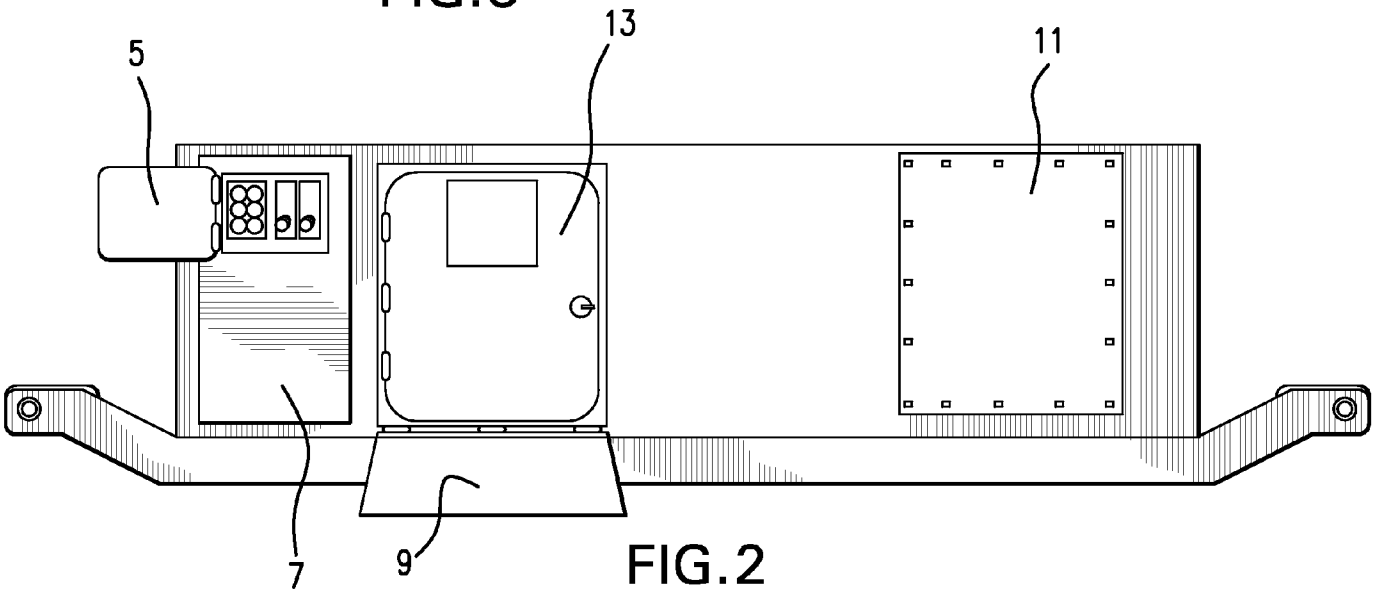
FIG. 2 provides a front elevational view of the storage container of FIG. 1, with its doors in the open position.

FIG. 2 shows the same structure as illustrated in FIG. 1, but in which the doors are in the open position. The opened valve access door 5 reveals push valves used to deploy the shelter, and gauges used to monitor the air bottle pressure. FIG. 2 also shows the position of the optional flexible air lock, not shown in FIG. 2, but which can be formed around door 13. The functions of the components revealed by FIG. 2 will be described later.

Figure 3:
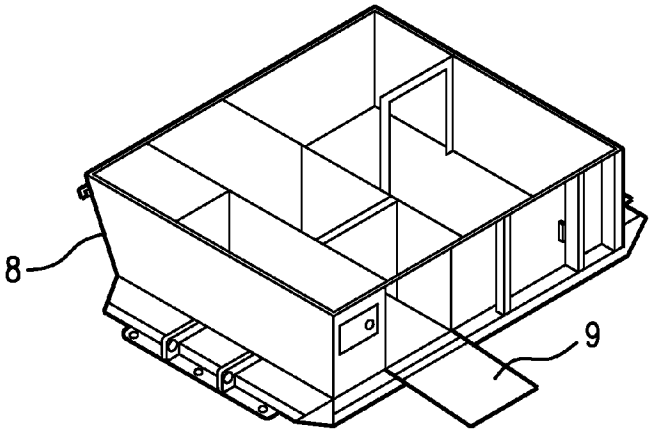
FIG. 3 provides a perspective view of the storage container of FIG. 1.

FIG. 3 provides a perspective view showing the storage container, with its top removed for visibility of its interior. The container is still resting on the skid, with the entrance ramp door 9 in the open position.

Figure 4:
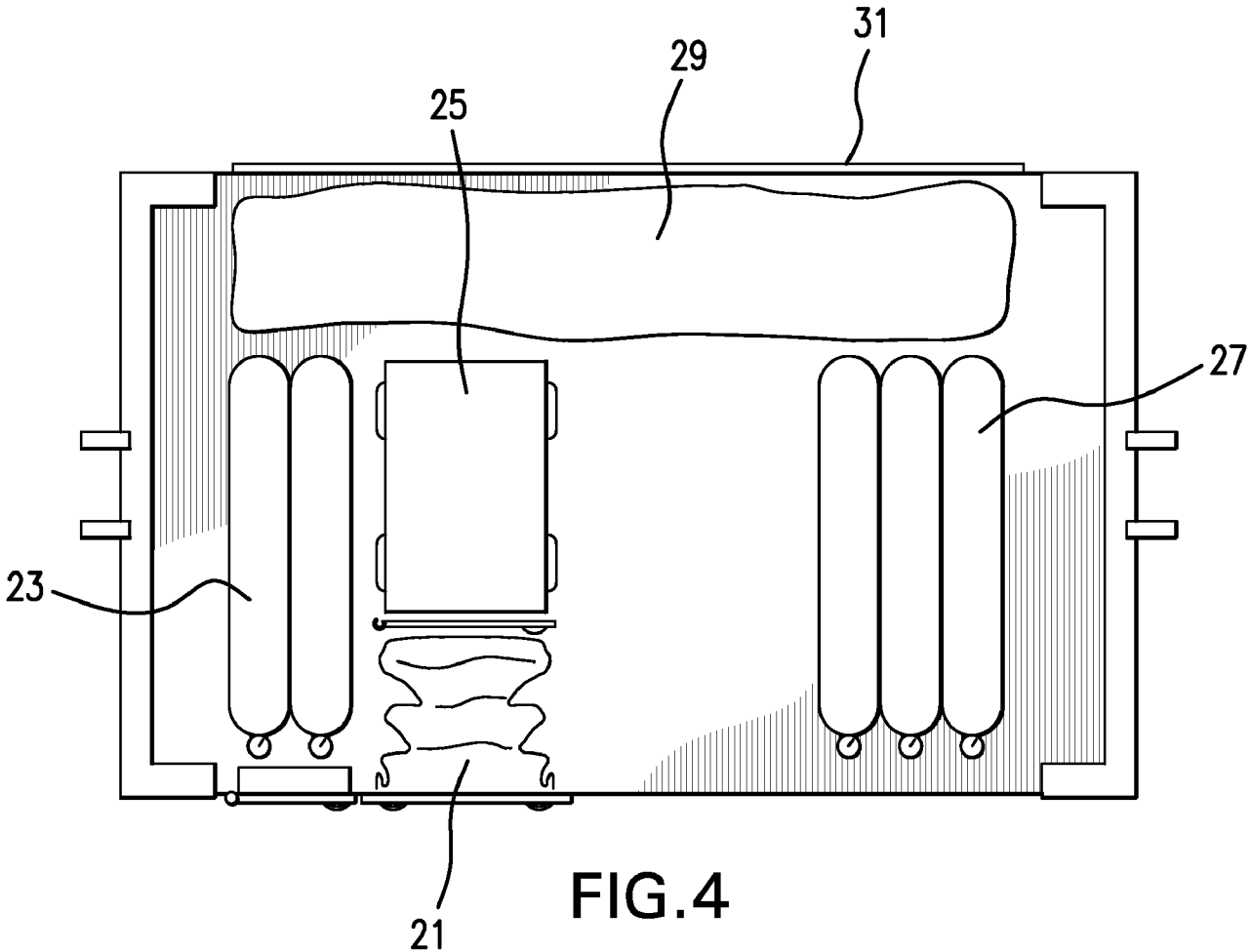
FIG. 4 provides a top view of one embodiment of the storage container used in the present invention, in which the doors are closed, this embodiment including a flexible air lock sleeve.

FIG. 4 provides a top view of the storage container with its doors closed, and illustrating the typical contents of the storage container. This figure shows the flexible air lock sleeve 21, shown in the stored condition. The flexible air lock sleeve is made of a foldable material so that the entire sleeve can be stored within the storage container as shown. Tanks 23 contain breathing air. A supplemental storage container 25 is provided behind the stored flexible air lock. Tanks 27 represent an oxygen supply, which could take the form of compressed air bottles or a chemical system for generating oxygen, or both.

Flexible shelter 29 is stored in a shelter storage area within the storage container. Deployment door 31 prevents the flexible shelter from deploying until needed.

The shelter 29 comprises an inflatable structure, made of a material which is flexible and which is substantially impermeable to gas and vapor. The shelter, which will be described in more detail later, preferably comprises columns and/or beams which assume their desired shape when fully inflated. In other words, the emergency shelter can be characterized as a balloon which, when inflated, assumes the shape of the desired shelter structure.

The storage container preferably contains supplies necessary for a group of persons to remain in the shelter for an extended period of time, such as two or more days, or longer. Typical supplies preferably include potable water, food, a chemical toilet, chemicals for generating oxygen, chemicals and/or devices for scrubbing carbon dioxide from the atmosphere in the shelter, equipment for removal of heat, a first aid kit, batteries, a battery charger, and monitoring devices for oxygen and carbon monoxide. Additional equipment and supplies could be stored in the container appropriate for the specific use for which the shelter is intended. For example, if the shelter is to be used in an underground mine, a methane monitor and/or communications equipment for contacting personnel at the surface could be provided.

In the stored configuration, as represented in FIG. 4, the shelter and all of the supplies and equipment are stored inside the storage container. When needed, the shelter can be deployed directly from the storage container. When deployed, the shelter stands adjacent to the storage container. During the deployment process, the storage container does not move, but the shelter is erected in a space adjacent to the container.

The shelter remains attached to the storage container in a substantially airtight manner. The storage container thus becomes part of the envelope of the shelter when the shelter has been deployed. All equipment and supplies can be accessed from inside the shelter without allowing any contaminated atmosphere to enter the shelter. The latter is accomplished by accessing the equipment and supplies through an opening linking the shelter and the storage container. In this way, once the storage container is positioned for storage, it does not need to be moved to operate the shelter. All equipment and supplies in the container are immediately available to the inhabitants of the shelter without being moved. The equipment and supplies in the container can thus be accessed as needed, throughout the entire time the shelter is operated.

Figure 5:
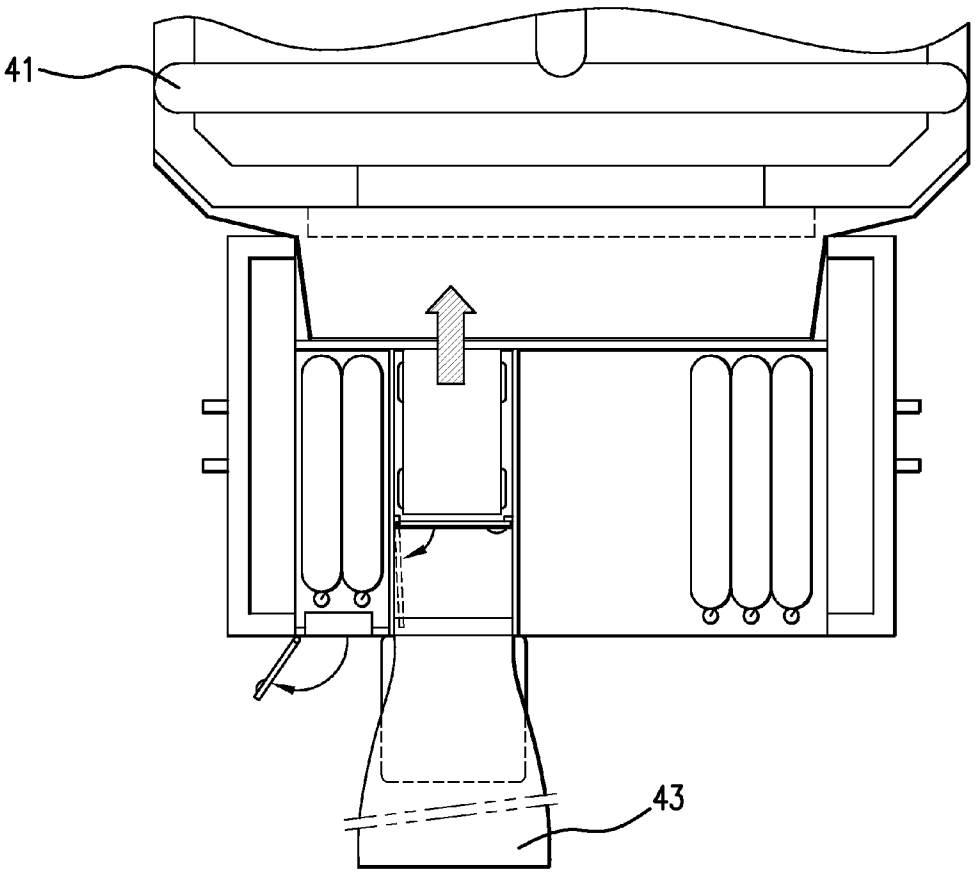
FIG. 5 provides a top view of the storage container of the present invention, wherein the shelter has been deployed, and in which the flexible air lock sleeve has also been extended.

FIG. 5 provides a top view, in partial schematic form, of the storage container of the present invention, showing a partial view of the shelter in its deployed condition, and showing the flexible air lock sleeve extended. Shelter 41, which is formed from structural elements defined by the material stored in the shelter storage area shown in FIG. 4, is shown in its fully extended position. Air lock sleeve 43, which provides access to the container, from the side opposite to that of the shelter, is also shown in the open and extended position.

Figure 6:
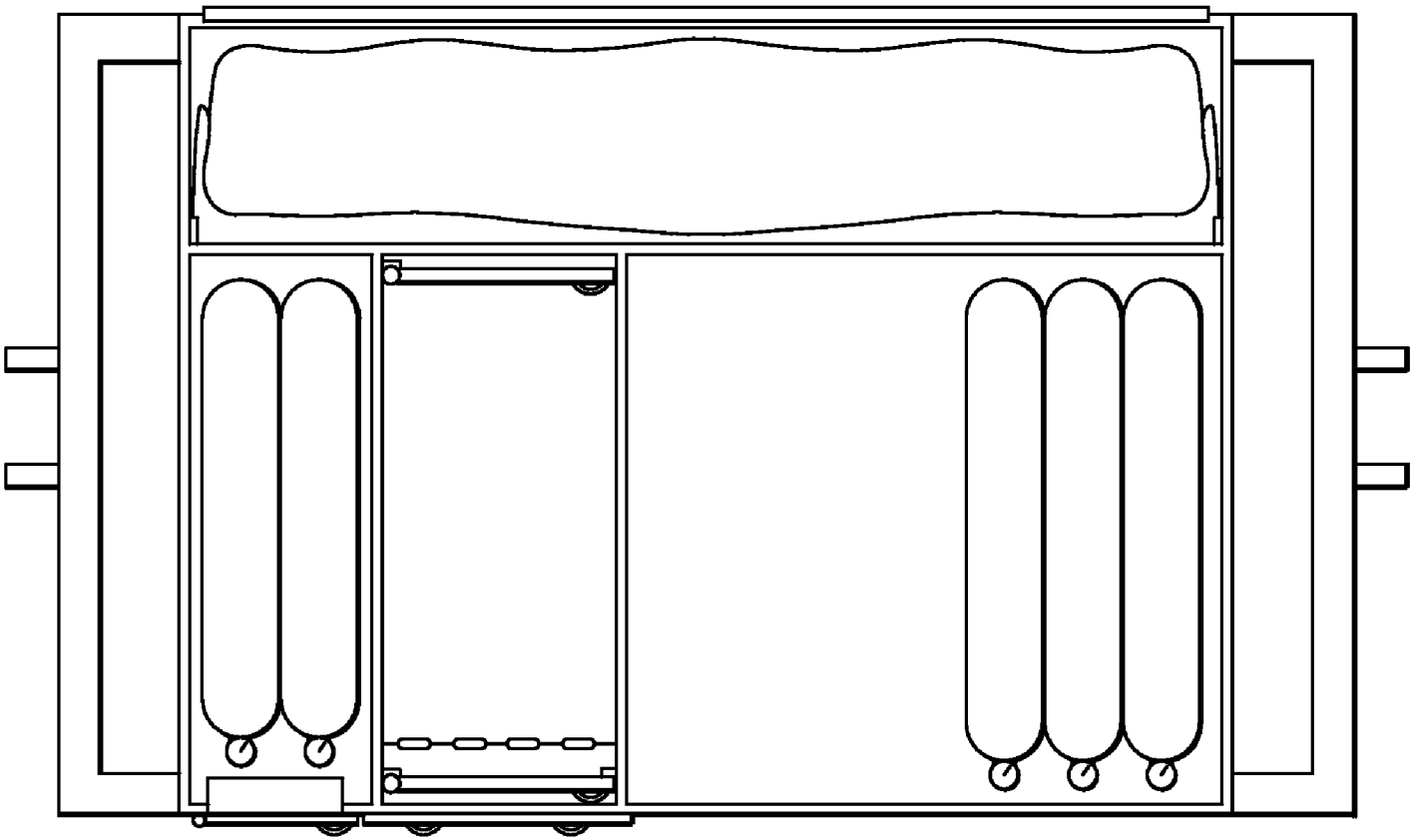
FIG. 6 provides a top view of another embodiment of the storage container of the present invention, in which the air lock comprises a rigid door, the door being shown in the closed position.

FIG. 6 provides a top view, similar to those of FIGS. 4 and 5, showing the container with its doors closed. The embodiment of FIG. 6 has a rigid air lock, formed by a door or panel instead of a flexible structure. The container is otherwise similar to those described above.

Figure 7:
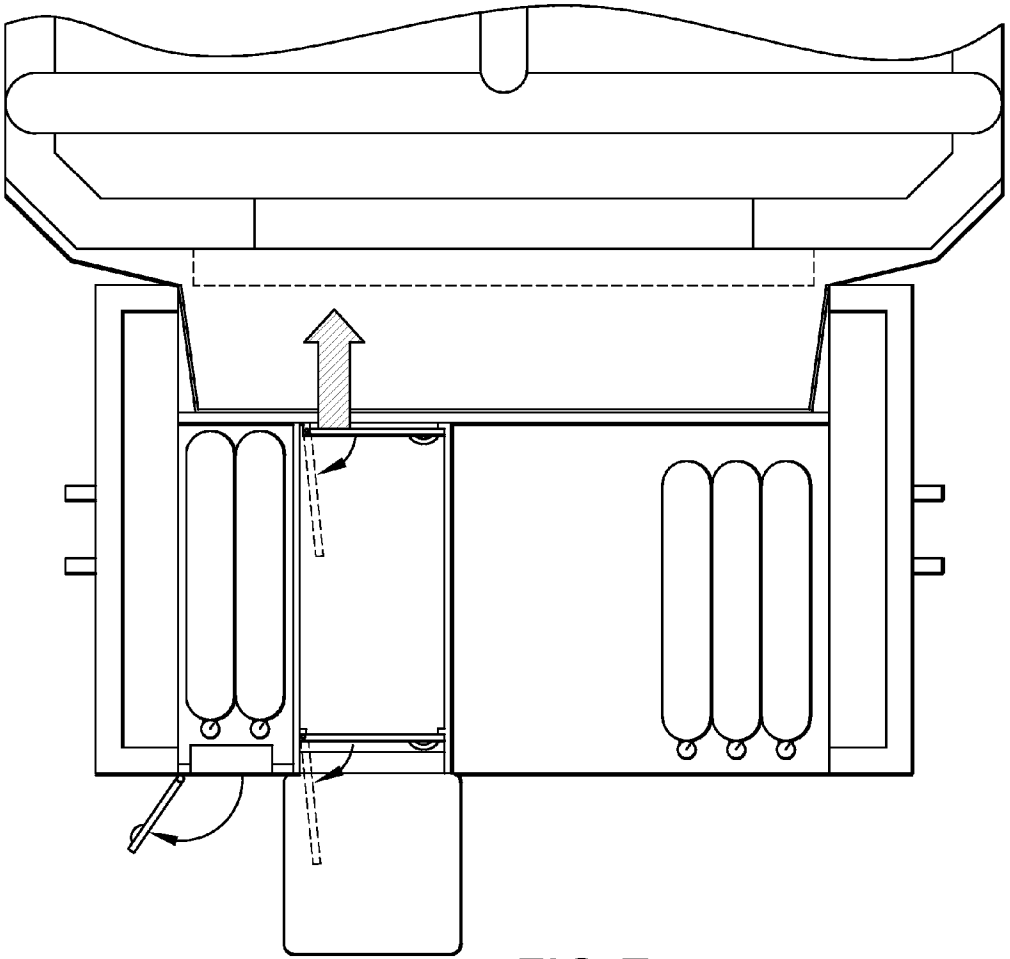
FIG. 7 provides a top view of the embodiment of FIG. 6, wherein the air lock is in the open position.

FIG. 7 provides a top view, similar to that of FIG. 6, showing the container with the shelter deployed. The embodiment of FIG. 7 uses a rigid air lock, which is shown in the extended position.

Figure 8A:
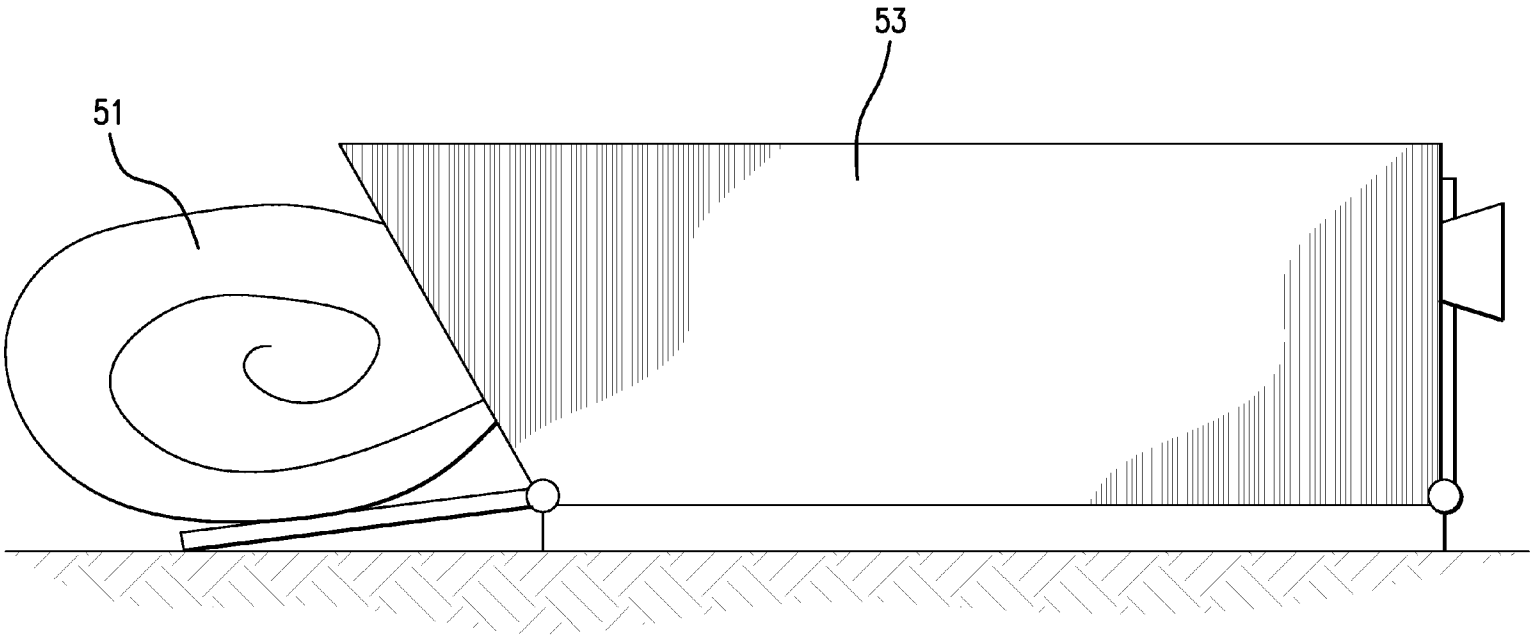
FIGS. 8*a*-8*c* provide front elevational views showing the shelter of the present invention as it is being deployed from the storage container.
Figure 8B:
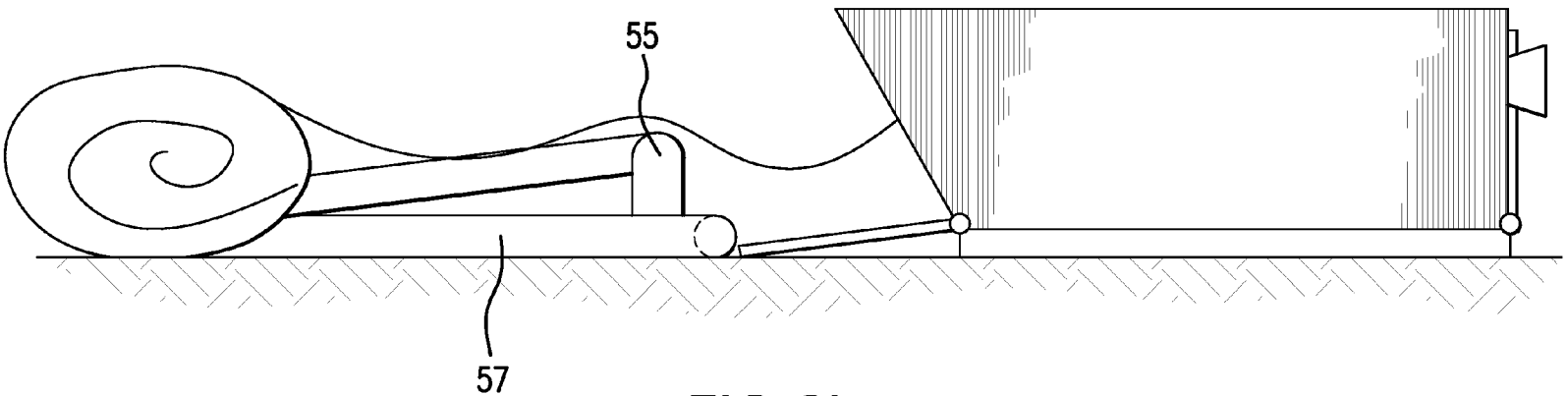
Figure 8C:
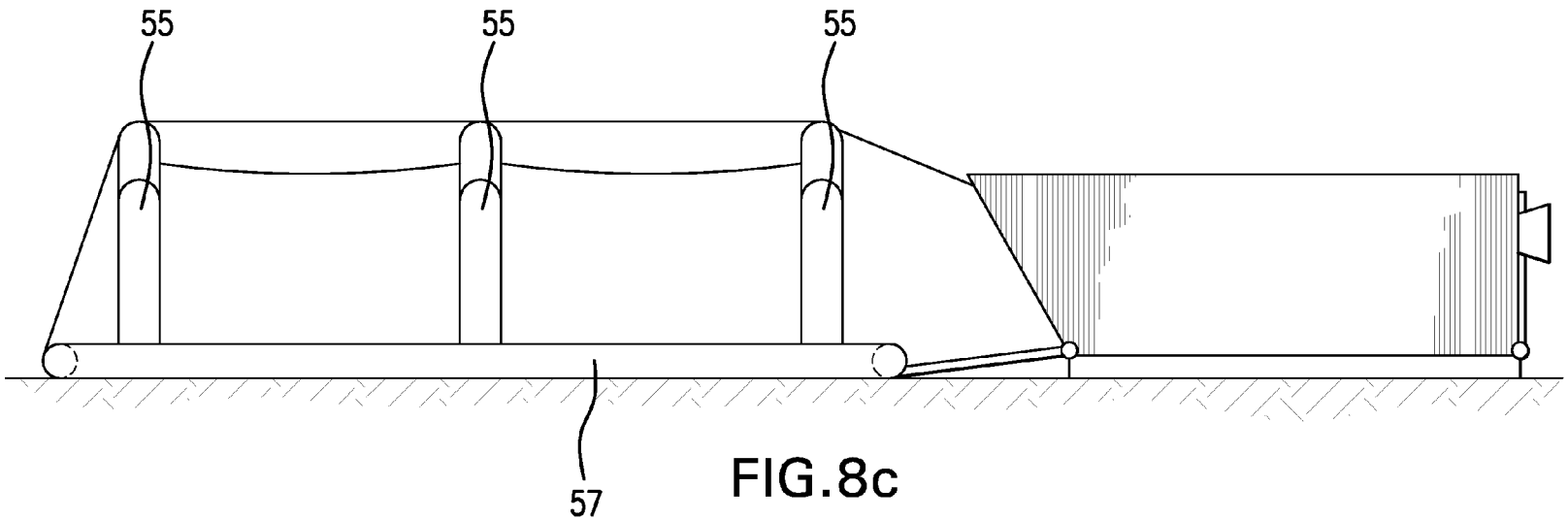

FIGS. 8*a*-8*c* provide a progression of diagrams illustrating the deployment of the shelter. Deployment of the shelter is initiated by operating a valve, such as one of the valves located behind access door 5 of FIG. 2, the valve being arranged to allow gas to flow from a source into the inflatable shelter.

FIG. 8*a* shows shelter structure 51 emerging from container 53, as the shelter is beginning to be inflated. FIG. 8*a* shows only one panel of the container, corresponding to side panel 8 of FIG. 3. The shelter emerges as a consequence of inflation. That is, compressed air is allowed to fill the shelter structure, causing the structure to assume its final desired shape. Thus, for example, the shelter includes column 55 and base 57, both formed from the inflation of the shelter structure, shown in FIG. 8*b*. FIG. 8*c* shows the shelter structure after it has been fully inflated. There are now a plurality of columns 55, extending from base 57.

Figure 9:
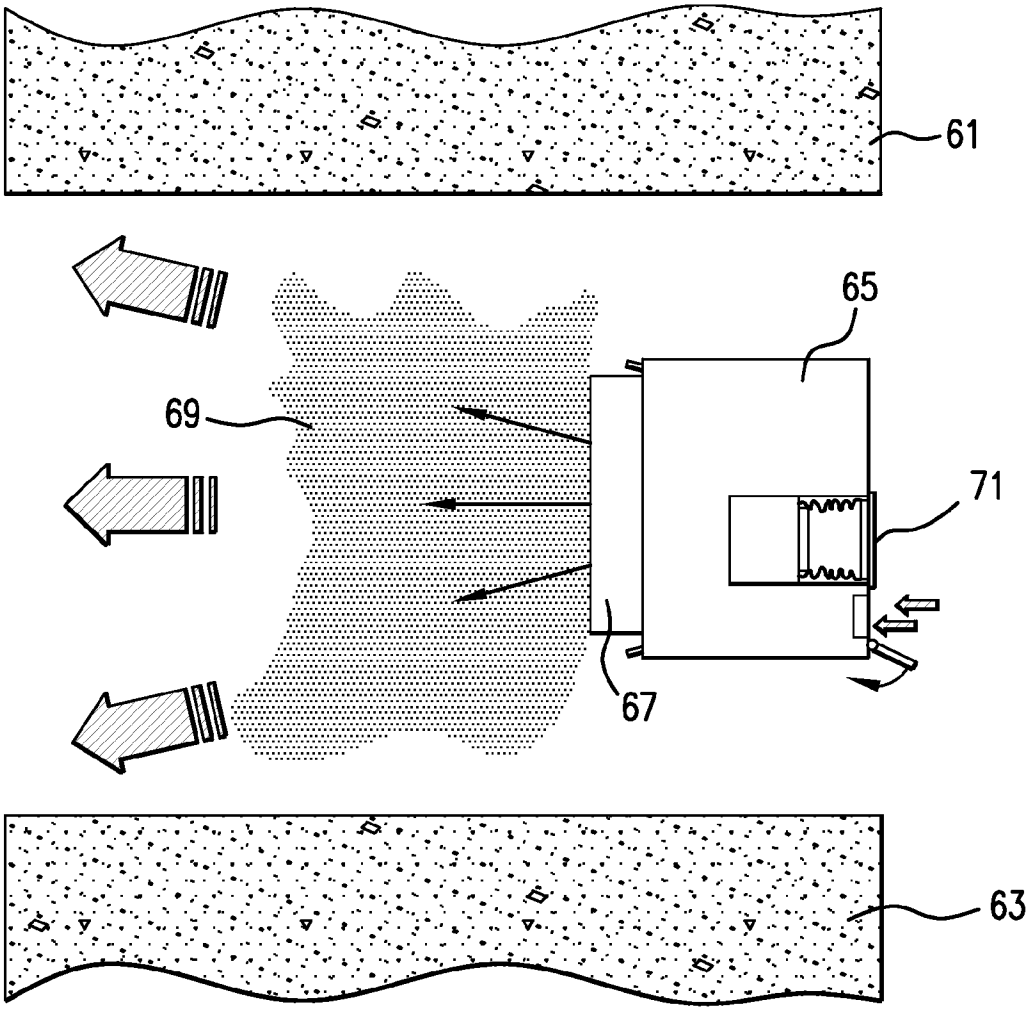
FIG. 9 provides a partially schematic top view illustrating the deployment of the shelter according to the present invention.
Figure 10:
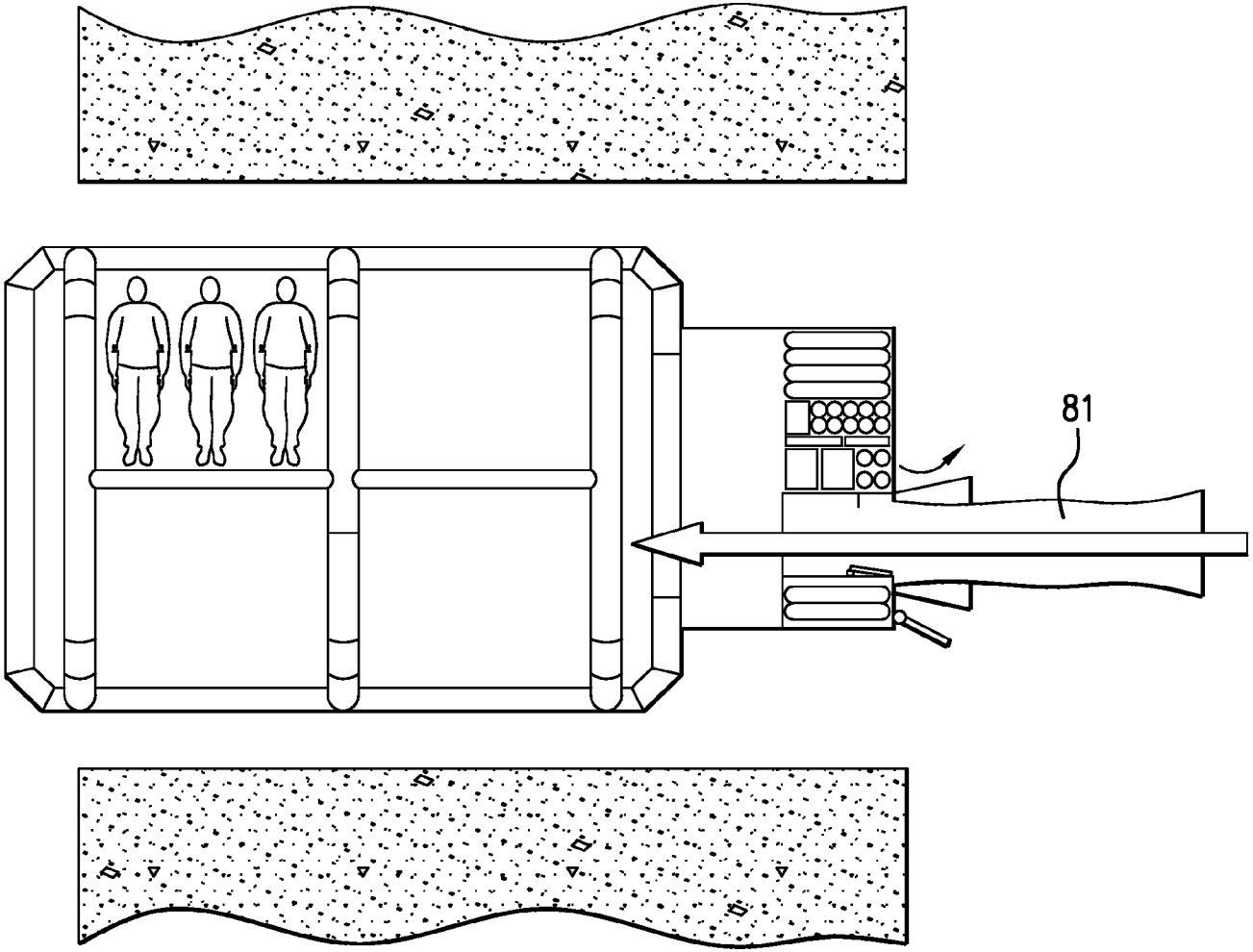
FIG. 10 provides a partially schematic top view, illustrating the shelter of the present invention wherein a flexible air lock has been opened, and wherein persons have occupied the space defined by the shelter.
Figure 11:
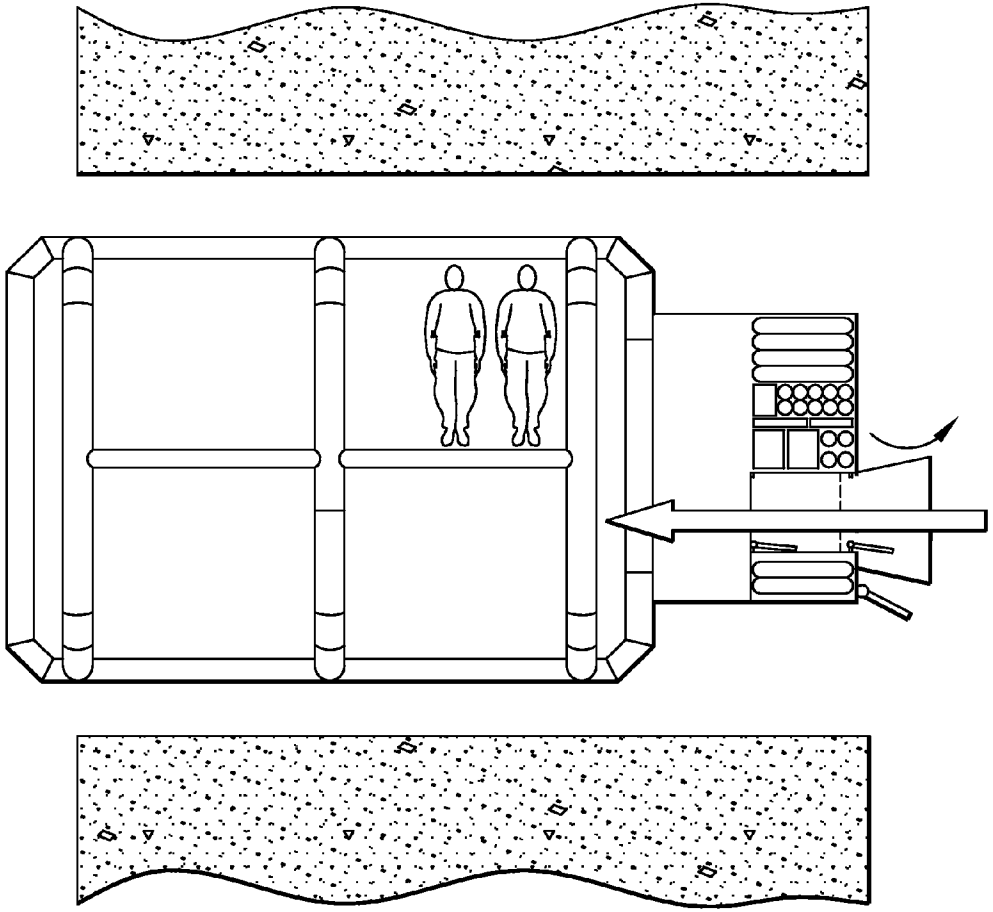
FIG. 11 provides a view similar to that of FIG. 10, but in which the air lock is rigid.

FIGS. 9-11 provide diagrams further illustrating the deployment and use of the shelter of the present invention. As shown in FIG. 9, storage container 65, which stores the shelter and the necessary life-supporting equipment, is positioned between walls 61 and 63. The walls may be the walls of a chamber in a mine, or they may be the walls of a tunnel, or other structure. The storage container may be positioned virtually anywhere, as long as there is space adjacent to the container, within which to erect the shelter.

Deployment of the shelter is accomplished by operating a first valve, which opens deployment door 67 (which is the same as deployment door 31 of FIG. 4) which allows the shelter 69 to emerge from the container, and then operating a second valve, which causes compressed air to fill the flexible shelter material 69 to build the shelter.

In the preferred embodiment, there are two operations requiring compressed air. First, compressed air is used to fill the flexible material defining the shelter, so as to construct the shelter. Secondly, air is directed into the space within the shelter, to provide a breathable atmosphere. Thus, air is used both for purposes of inflation of the structural members of the shelter, and then for the purpose of filling the shelter enclosure with a breathable atmosphere. Separate valves can be used to perform these two operations.

In one preferred embodiment, the present invention is designed to provide space for about 18-20 persons. The shelter can be formed in various heights. In one embodiment, the height of the inflated shelter could be about 54 inches. The total time for full deployment can be about 1-3 minutes. During this time, the persons who will be using the shelter can open the entry door, represented by reference numeral 71 in FIG. 9, and expand the flexible air lock (shown in FIGS. 9 and 10), or open the rigid door air lock (as shown in FIG. 11), in preparation for their entry into the shelter.

In another embodiment, the scale of the shelter can be enlarged, and the shelter can be designed to accommodate up to 35 persons, for periods as long as 96 hours. Other such variations can be made, within the scope of this disclosure.

FIG. 10 provides more detail about the process for entry into the shelter. This figure shows the flexible air lock sleeve 81 in its open condition. The flexible air lock contains a zipper or equivalent fastener (not shown). After the person or persons using the shelter enter through the flexible air lock, and have moved towards the shelter door (towards the left in FIG. 10), the zipper is closed. Then, the door leading from the container to the shelter can be opened, and the persons can enter the shelter. The door to the shelter is then preferably closed. FIG. 10 illustrates various persons located within the shelter.

FIG. 11 illustrates the same process shown in FIG. 10, for the case in which the air lock is rigid. In this case, the air lock comprises a double door system. The persons entering the shelter open the outer door, then move into the air lock area and close the outer door. The persons move towards the shelter door (towards the left in FIG. 11). The door to the shelter is opened, and the persons enter. The shelter door is then preferably closed.

The rigid air lock, discussed above, comprises two rigid doors with a flexible curtain located between the two doors. The air lock reduces the likelihood that toxic air will enter the shelter when persons enter the device. The flexible air lock has the additional advantage that it permits up to three more persons to be located within the air lock, due to the fact that the flexible air lock can be extended in length. The flexible air lock is especially suitable for accommodating a person on a stretcher.

Figure 12:
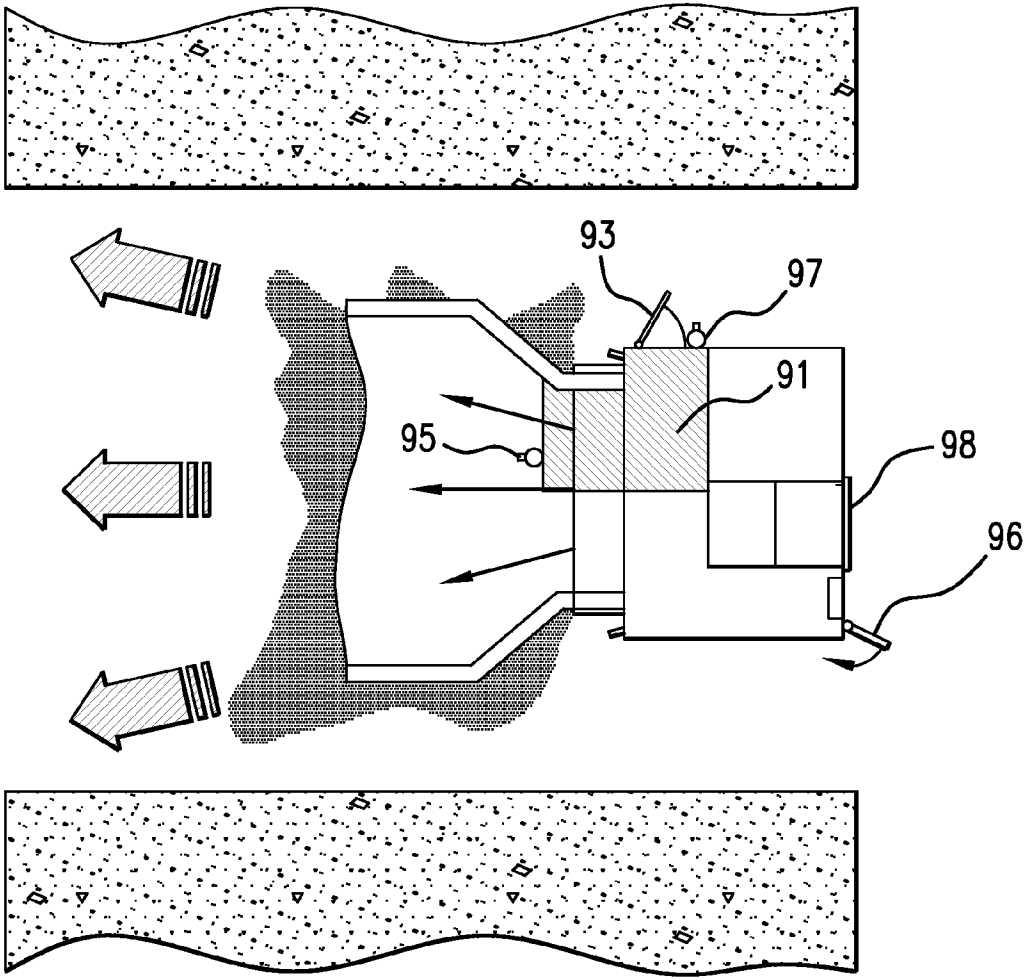
FIG. 12 provides a view similar to that of FIG. 9, showing an alternative embodiment in which the air lock is at least partly located within the deployed shelter.
Figure 13:
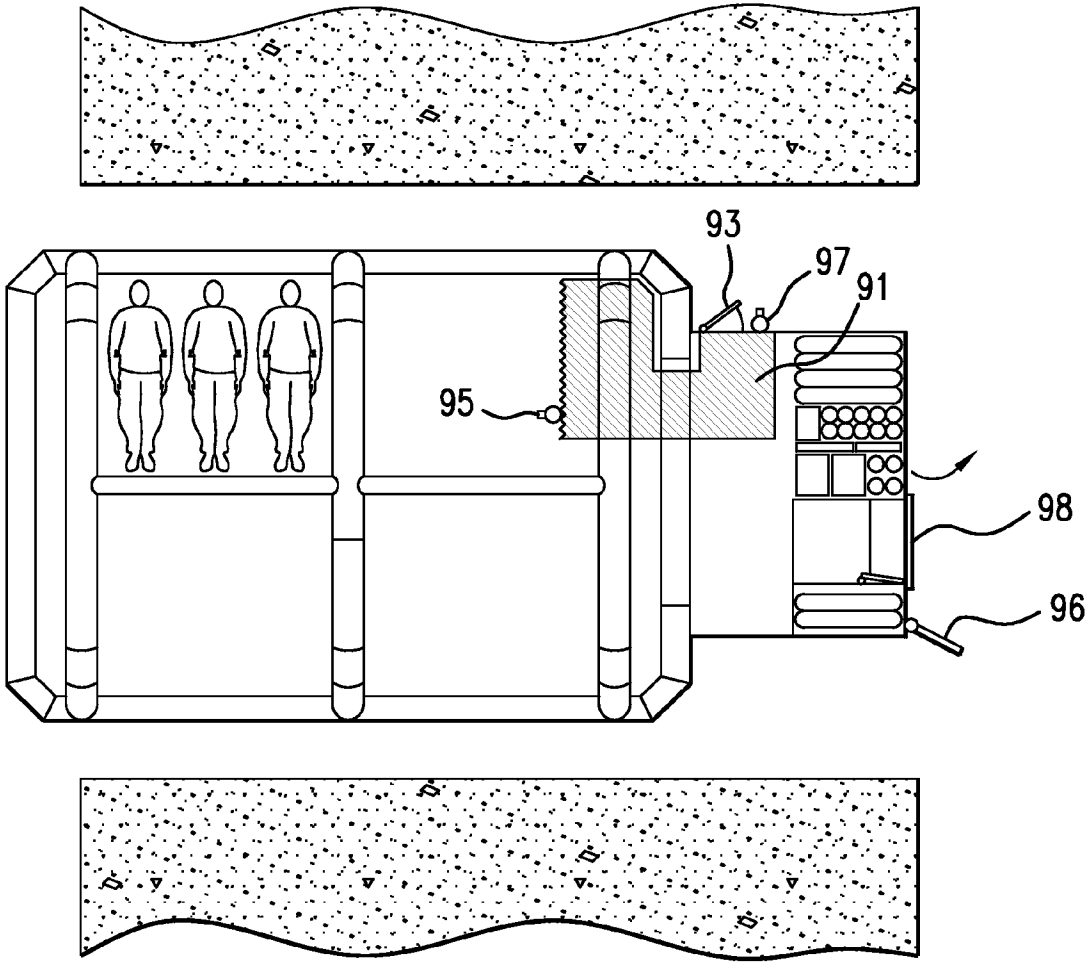
FIG. 13 provides a view similar to that of FIG. 10, also showing the alternative in which the air lock is at least partly located within the deployed shelter.

An alternative, and more preferred, embodiment is shown in FIGS. 12 and 13. FIGS. 12 and 13 provides views which correspond, respectively, to those of FIGS. 9 and 10. In this preferred alternative, the air lock is located at least partly within the shelter portion of the structure, instead of being located entirely within the storage container. This embodiment conserves valuable space within the storage container, making it possible to store more supplies in the container.

In FIG. 12, the air lock 91 is represented by a shaded portion. As in the other embodiment, the air lock itself comprises a flexible, inflatable material. The air lock has a forward end which can be opened with a zipper, or its equivalent, providing access to the inside of the shelter. Before deployment of the shelter, the air lock is contained within the folded flexible material which will define the shelter, and is itself folded. The air lock is arranged such that it deploys at the same time as the shelter as a whole. As shown in FIG. 12, which shows the shelter after it has been deployed, the air lock extends into the shelter. A separate air lock door 93 provides access to the air lock from the outside.

In this alternative embodiment, at least part of the air lock is within the deployed shelter. The entrance from the outside, into the air lock, is through door 93, which may be made of steel. The entrance from the air lock into the inside of the shelter is through a zippered opening.

A low-pressure one-way relief valve or check valve 95 vents air from the living space, within the deployed shelter, to the air lock. A second check valve 97 vents air from the air lock to the outside. This arrangement is useful for the following three reasons.

First, the air flow into the air lock area prevents the creation of a vacuum in the air lock during deployment, and thus allows the air lock area to inflate during initial deployment.

Secondly, whatever contaminated air may enter the shelter during the initial entry of victims will be purged through the air lock area to the outside.

Thirdly, continuing the slow air flow from the compressed air cylinders will maintain a slight positive pressure. Therefore, if there were any harmful gases in the vicinity of the shelter, such gases could not enter the shelter due to the positive pressure therein. This positive pressure is controlled and regulated by setting a predetermined air flow resistance level over the pressure relief valve.

The present invention has the major advantage that it is compact in size when not in use, all components being densely packed within the container. The shelter occupies substantial space only when deployed. Indeed, when the shelter is deployed, the volume of the shelter may become comparable to, or greater than, the volume of the storage container from which it emerges.

In FIGS. 12 and 13, the air lock is partly disposed within the shelter and partly located within the storage container. Other configurations could be used instead. For example, the air lock could be positioned entirely within the shelter. The air lock could also be located at various positions within the shelter. Such alternatives should be apparent to the reader skilled in the art.

FIGS. 12 and 13 also show the main door 98 which provides access to the storage container, as well as the valve access door 96, which provides access to the control valves used to inflate the shelter.

The invention may be modified in various other ways, as will be apparent to those skilled in the art. The specific contents of the storage container can be varied, as can the structure of the air lock doors. The configuration of the shelter itself can also be modified, within the scope of the invention. Also, the positions of the valves and the valve access door can be modified, and can be different from those shown in the figures. These and other modifications should be deemed within the spirit and scope of the following claims.

What is claimed is:

1. Apparatus for providing an emergency shelter in a mine, comprising:

a) a container formed of a rigid material, the container having a folded, flexible material disposed within the container, the flexible material being sealed to the container, wherein the container and the flexible material together define a region which is airtight with respect to an outside environment, b) the flexible material defining structural elements and an enclosure comprising a living area, and c) means for storing a compressed breathable gas within the container, and for separately directing said gas into the structural elements and into the enclosure formed by the flexible material, wherein the flexible material becomes erected into a shelter adjacent to the container while remaining sealed to the container, wherein the erected shelter has a volume greater than that of the container, and wherein the compressed breathable gas is the sole source of gas for inflating the shelter.

2. The apparatus of claim 1, wherein the container holds supplies which are useful for life support.

3. The apparatus of claim 2, wherein said supplies comprise one or more items selected from the group consisting of potable water, food, a chemical toilet, compressed air, chemicals for generating oxygen, chemicals and/or devices for scrubbing carbon dioxide from the atmosphere in the shelter, equipment for removal of heat, a first aid kit, batteries, a battery charger, and monitoring devices for oxygen, carbon monoxide, and methane.

4. The apparatus of claim 1, wherein the folded flexible material is stored in a vicinity of a first side of the container, the container further comprising an air lock door located on a second side of the container, distinct from the first side, the air lock door providing means for entry of personnel into the shelter without substantial inflow of gas from an outside environment.

5. A method of providing an emergency shelter in a mine, comprising the steps of:

a) storing a folded, flexible material in a rigid container, the flexible material being sealed to the container, such that the flexible material and the container together define a region which is airtight with respect to an outside environment, the flexible material defining structural elements, the container also including an enclosure comprising a living area, the container also including a compressed breathable gas, b) placing the container, with the folded flexible material inside, in a mine, c) separately directing the compressed breathable gas into the structural elements and into the enclosure defined by the flexible material, so as to inflate the structural elements and to fill the enclosure with breathable gas, wherein the flexible material becomes erected into a shelter adjacent to the container while remaining sealed to the container, and wherein the erected shelter has a volume greater than that of the container, and wherein the compressed breathable gas is the sole source of gas for inflating the shelter.

6. The method of claim 5, further comprising storing, within the container, supplies which are useful for life support.

7. The method of claim 6, further comprising selecting said supplies to be one or more items selected from the group consisting of potable water, food, a chemical toilet, compressed air, chemicals for generating oxygen, chemicals and/or devices for scrubbing carbon dioxide from the atmosphere in the shelter, equipment for removal of heat, a first aid kit, batteries, a battery charger, and monitoring devices for oxygen, carbon monoxide, and methane.

* * * * *